US006851378B2

(12) United States Patent
Amory

(10) Patent No.: US 6,851,378 B2
(45) Date of Patent: Feb. 8, 2005

(54) ARTICULATED MULTI-HULL WATER CRAFT

(76) Inventor: Jonathan Amory, 188 Pine St., Portland, ME (US) 04102

( * ) Notice: Subject to any disclaimer, the term of this patent is extended or adjusted under 35 U.S.C. 154(b) by 0 days.

(21) Appl. No.: 10/405,194

(22) Filed: Apr. 2, 2003

(65) Prior Publication Data

US 2004/0050313 A1 Mar. 18, 2004

Related U.S. Application Data

(60) Provisional application No. 60/410,063, filed on Sep. 12, 2002.

(51) Int. Cl.[7] ..... B63B 1/00
(52) U.S. Cl. ..... 114/61.15; 114/39.28
(58) Field of Search ..... 114/61.15, 61.16, 114/39.26, 39.28, 61.11, 91, 123

(56) References Cited

U.S. PATENT DOCUMENTS 3,002,484 A * 10/1961 Dube ..... 114/61.16
3,232,261 A * 2/1966 Graig ..... 114/123
3,509,842 A * 5/1970 Mitchell ..... 114/61.15
3,566,819 A * 3/1971 Keddie ..... 114/39.28
3,696,772 A 10/1972 Sundelin
3,881,440 A * 5/1975 Mason ..... 114/123
4,159,006 A * 6/1979 Thurston ..... 114/123
4,192,247 A 3/1980 Riordan
4,457,248 A * 7/1984 Thurston ..... 114/61.11
5,277,142 A * 1/1994 Connor ..... 114/61.16
5,682,831 A * 11/1997 Yokoi ..... 114/39.26

* cited by examiner

*Primary Examiner*—S. Joseph Morano
*Assistant Examiner*—Lars A. Olson
(74) *Attorney, Agent, or Firm*—Thomas L. Bohan; Patricia M. Mathers

(57) ABSTRACT

A multi-hull vessel capable of planing. The vessel has a rigid superstructure that is rotatably linked to flat-bottomed hulls. As the vessel heels, the pivotable connection between the superstructure and the hulls allows the superstructure to heel over while the hulls remain oriented so that their bottoms are parallel to the water surface. This allows the multi-hull vessel to plane at relatively low speeds without risking the consequences of a leeward planar hull digging into the water. Further, the vessel is made of lightweight components and configured to be assembled and disassembled in a short time by a single individual, and to be easily lifted and carried atop an automobile for overland transport.

18 Claims, 3 Drawing Sheets

ARTICULATED MULTI-HULL WATER CRAFT

This application claims the benefit under 35 USC §119(e) of the Provisional Application 60/410,063 filed on Sep. 12, 2002.

BACKGROUND OF THE INVENTION

1. Field of the Invention

The present invention relates to the field of sailboats having more than a single hull, such as catamarans and trimarans. More particularly, the invention relates to a design modification that enhances the practicable speed that can be obtained from a small multi-hull sailboat. More particularly yet, the invention relates to such a modification that enhances the ability of the boat to plane.

2. Prior Art

Many serious sailors seek very high performance in a sailing dinghy. Ideally, the dinghy is relatively inexpensive and is easily loaded on top of a vehicle and transportable overland. Unfortunately, the highest-performance sailing dinghies, such as the WindRide RAVE, are both expensive and difficult to transport. Although the most popular relatively-low-cost sailing dinghy, the LAZER, is fast, it is not extremely fast and, furthermore, it is cumbersome to transport.

There are two main design approaches to increasing the speed at which a sailboat can go: increase the force of the wind against its sails; decrease the drag to which its hull is subject. At low speeds, hull drag is dominated by frictional forces across the entire hull/water interface. Efforts to minimize it include designing and maintaining a smooth hull surface. At speeds higher than about $1.34\times L^{1/2}$, where L is the length of the hull at the water line (often designated D.W.L.), hull drag is dominated by the hull's wave-making. Hull-created waves are of two types: (a) long wavelength disturbances created by the hull's lateral displacement of water it moves through it, waves that propagate perpendicular to the boat's direction of movement; (b) short wavelength turbulence that appears immediately behind the stern. If and when the boat begins to rise up in the water to a planing configuration, reducing the volume of water the hull must displace as it moves forward, drag due to wave generation is greatly reduced. When the hull is planing it is in effect skimming along the water's surface rather than plowing through the water. The more readily a boat will plane, the higher the speed it can attain with given sail area and wind.

In effect, a boat planes—moves up on top of the water—because it is moving so fast that the water cannot get out of its way, just as an automobile tire rides up onto a thin film of water if it is moving fast enough, a phenomenon referred to as hydroplaning. In each case, the water under the object exerts an upward force on the object at the object/water interface that is equal to the weight of the object. In the case of the tire, this is about ¼ the weight of the car. It can also be stated in terms of equating the pressure exerted upward by the water to the pressure exerted downward over the total object/water contact area. The upward pressure that the water can exert against an object moving across its surface is proportional to the square of the speed of the object. Thus, in the case of the automobile tire, where the contact area remains essentially the same as the tire begins to hydroplane, the speed at which hydroplaning commences is proportional to the square root of the tire's air pressure. $V_{Plane}=\text{Const.}p^{1/2}$. In the case of a boat's hull, the contact area tends to become smaller as the hull rides higher in the water. Also, since the boat's weight tends to increase with length, the general expression for planing speed of a boat is stated in terms of its length, even though ultimately it is the pressure that is crucial. A typical general expression for the threshold speed for a boat's planing is $V_{PLANE}=2.5L^{1/2}$, where L, the waterline hull length is given in feet, and the speed will be expressed in knots. The exact speed at which planing will commence will vary from boat to boat, depending on the shape of the hull. If one wishes to enhance the planing ability of a boat of given weight, that is, to lower the speed at which it starts to plane, one flattens the hull. If all other things are equal, this will minimize the pressure for a given weight.

Of course, other things are not all equal; and shifting a sailboat's hull shape away from the traditional contoured configuration and toward a flat-bottomed shape greatly increases the boat's vulnerability to capsizing as the wind speed increases, a serious impediment to attaining high speed. Thus, if one wishes to enhance the planing capacity by going to a flat-bottomed hull, other changes must also be made to the boat's design.

A boat moving slower than its planing speed travels through the water in "displacement mode." Large mono-hull sailboats tend to always operate in displacement mode, being unable to reach planing speeds because of the shape of the hull and the tremendous residual wave-making forces, which increase exponentially with increasing speed.

For a given hull design, it would seem that deploying a greater sail area would increase the ability of the boat to plane. However, this results in a greater overturning moment, tending to capsize the boat, both because of the greater force and because of the generally greater moment arm as the masts are increased in height in order to accommodate more sail. So, again, a straightforward approach to improving the planing capacity results in an increased likelihood of capsizing the boat, or at least of a wind-dumping blow-down, before the planing speed is attained.

In a standard single-hull sailboat, the wind-generated overturning moment causes the hull to heel toward the leeward side. If the boat has a heavy keel, this heeling forces the keel upward and windward, automatically producing a righting moment that counters the overturning moment. Ideally, the righting moment and the overturning moment are in dynamic equilibrium and the boat moves along without capsizing. The hull shape may also contribute to the righting moment, thereby allowing the boat to take advantage of greater wind forces. This is accomplished by designing the hull so that as it heels, it displaces more water, thereby increasing buoyancy on the leeward side and adding to the righting moment. Furthermore, the crew of the vessel also provide an adaptable righting moment by being able to lean out, or hike out, from the deck on the windward side, thereby adding their weight to the righting moment. However, this in general is a significant righting-moment contribution only for small boats with small or absent keels.

In contrast to mono-hull boats with keels, catamarans gain their righting moment primarily by the spread between the two hulls, so that an entire hull is always a large distance to leeward from the center of mass, thus giving a large moment arm (with respect to the boat as a whole) on which the buoyant force on that hull operates. The hulls of a conventional catamaran are narrow, and shaped to minimize wave-making; they are sometimes referred to as wave-piercing hulls, because of their ability to cut through waves. As such, they are fast hulls, although they are incapable of planing because of this very sharpness. Because of the strong righting moments, catamarans are able to support a large sail area relative to their weight. Large catamarans are therefore generally faster than mono-hull sailboats of similar weight.

Nevertheless, the speed advantages of the catamaran in comparison with mono-hull sailboats largely disappear when a small catamaran is compared with a small mono-hull boat. This is because a small mono-hull sailboat, with a shorter, lighter hull, is able to plane at wind speeds that are typically available. Furthermore, a small boat does not need to carry heavy fixed ballast, because of the ability of the crew to serve well as movable ballast. Given that the crew hike out to windward as needed, the weight of a typical crew can generate the righting moment produced by a keel of much greater weight and thus be more than adequate to counter the overturning moment generated by the wind on the sail area deployed by a small mono-hull boat. The result is that a small mono-hull sailing dinghy can deploy a great area of sail without requiring a heavy keel. Without the need for a heavy keel, the small sailing dinghy can have a light flat hull capable of planing at low speed and of exerting very low drag while planing.

Attempting to negate the advantages of the small mono-hull sailboat by simply equipping a catamaran with wide flat hulls will not work, since the slightest heeling causes a corner of the flat hull on the leeward side to dig into the water, destroying the planarity of the hull contact with water. For these various reasons, small high-performance mono-hull boats are often faster than small catamarans.

If it were possible to maintain the catamaran hull flat on the water while the mast and sail react to the wind's forces, greater use could be made of those forces in driving the vessel to higher speeds. Traditionally, the hulls, the platform, and the mast move together as a unit. In the absence of wind, the platform is parallel to the water, and the mast is vertical. When the wind blows, the mast tips from the vertical to the leeward and the platform tips from the horizontal, so that the windward side goes up and the leeward side down. The angle at which the hulls intersect the water changes commensurately. Of course, as noted above, the hulls on catamarans are rounded; therefore, even when the boat is upright, no hull surface is parallel to the water surface.

There have been attempts in the past to de-couple the orientation of the mast from that of the hulls and platform. The goal of these attempts, however, was simply to improve the stability of the craft for the comfort and safety of its occupants, rather than to permit increased speed. Sundelin (U.S. Pat. No. 3,696,772; issued Oct. 10, 1972), although not directed at multi-hull vessels, per se, addresses some of the stability problems of such vessels, teaching a variably positioned outrigger device that effectively converts a mono-hull boat, including canoes and other non-sail-powered craft, into a three-hull sailboat. The gist of Sundelin is that the outriggers can be shifted with respect to the longitudinal axis of the central hull so that a longer righting-moment-arm can be deployed leeward. In particular, by changing the angle at which the outrigger-coupling rod encounters the mast, that part of the boat holding passengers can be maintained parallel to the water's surface even as the mast heels over as if in a blow-down. In other words, the device of Sundelin is directed entirely to the safety and comfort of passengers, and has no features that enhance the speed of the craft. Rather than being configured to take maximum advantage of high winds, it is designed to dump the wind without the hull heeling over significantly. Sundelin views extreme heeling over as a safety and comfort problem. In the present context, extreme heeling over, so that the craft capsizes or dumps wind, is viewed as a speed problem, one that robs the boat of the speed that it might otherwise attain.

Riordan (U.S. Pat. No. 4,192,247; 1980) discloses a trimaran that has braces extending from the mast on the center hull to the trimaran's outer hulls, which are conventionally narrow and rounded. The bracing system increases the available righting moment of the vessel. It does nothing, however, to enable the vessel to plane as a means of attaining higher speeds.

Therefore, what is needed is a multi-hull vessel that takes full advantage of available wind, regardless of its size. What is yet further needed is such a vessel that is easily transportable.

SUMMARY

It is a primary object of the present invention to produce a multi-hull vessel that is not size-limited in taking advantage of strong winds. It is a further object to provide such a vessel that is easily loadable on a transport vehicle for overland transport.

The way to achieving the primary object is to produce a multi-hull vessel that planes and can sustain strong winds without capsizing. The second object follows from using lightweight components and providing for their easy disassembly and assembly.

Although for definiteness, the invention will be discussed in terms of catamarans, it will be clear that the basic concepts underlying it extend to all classes of multi-hull boats. In this discussion, terms such as boat, vessel, watercraft, and the like shall be used interchangeably and without any distinction intended between their meanings.

It is well-known that an important route to reducing drag on a vessel's hull is to cause it to plane, in which mode of movement it can be described as skimming across the water. When one is dealing with a catamaran, the basic nature of the boat works against planing. For one thing, the hulls of the traditional catamaran are round-bottomed, the antithesis of the flat, broad hull that facilitates planing at a low speed. If one simply replaces the traditional catamaran hulls with broad, flat hulls, the propensity of the leeward hull to dig into the water under heeling conditions can prevent the vessel from reaching a planing mode or, if it is planing, can cause it to suddenly cease planning.

Thus, the present invention combines flat, broad catamaran hulls with a design that discourages either hull from digging into the water. More specifically, the invention permits heeling to occur, but limits it to the superstructure of the vessel, while constraining the hulls to remain parallel to the surface of the water. This is done by introducing a pivoting coupling between the superstructure and each of the hulls. For present purposes, the superstructure can be thought of a the mast and the platform of the catamaran. In general, it is everything except for the hulls.

With the hulls pivotally coupled to the superstructure, the mast (and sail) can heel over under the force of wind while the flat-bottomed hulls remain parallel to the water. Consequently, planing is achievable at a relatively low speed, after which the drag, caused predominantly, in this context, by turbulence formation, is drastically reduced and the vessel can be driven very efficiently by the wind.

With a catamaran, the crew provide a very large righting moment as needed by shifting their weight to windward. In a boat constructed according to the invention, the combination of this very large righting moment and the independent articulation of the hulls enables the vessel to quickly reach planing speed. Further, with the platform and mast rotating along a longitudinal axis with respect to the hulls, the hulls continue to remain parallel to the water after planing speed is reached, regardless of the degree of heel of the mast. This is essential to the success of the design because of the tendency of the catamaran to lose its planing capacity should one of the (flat) hulls dig into the water. Since the planar hulls of the present invention always remain parallel to the water's surface, they are far more effective planing surfaces than existing planing hulls that need to allow for some heel.

Although the essence of the present invention is the pivotable coupling between the superstructure and the hulls, the exact method by which this pivoting capacity is provided is not important. There are many ways to do it, including the use of such simple devices as pin joints in each hull at the waterline, pin joints that pivotally support the superstructure.

The inventor has conducted multiple trials on a vessel incorporating the innovations described above. To test the hulls themselves, a prototype boat using flat hulls was towed behind a motorboat, during which test the hulls performed according to design, rising to plane easily and at low speeds and not rolling when pushed sideways. Next a complete prototype with superstructure moving on its own in winds of less than 6 mph was tested on the Connecticut River. The boat moved smoothly and, even in the light prevailing wind, actually approached a full plane, though did not quite achieve it. The vessel was then equipped with a larger mast and brought out into Penobscot Bay for testing in stronger winds. With sustained winds of 10 to 12 mph, and gusts up to 17 mph, full planing was consistently achieved. On a beam reach, the test craft traveled at a speed over the water of 8 mph in a 7 mph wind, 14 mph in a 10 mph wind, and 16 mph in 17 mph wind. When close-hauled, this test craft sailed at a speed of 7 mph while maintaining a heading of about 45 degrees to the prevailing 9 mph wind This prototype used for each of its twin hulls a long "wind-surfing" board that had a composite outer surface and a foam core. Other embodiments of the invention can, of course, use a wide variety of hull materials and dimensions.

The other feature that separates the catamaran of this invention from traditional catamarans is its transportability. Most sailing dinghies weigh around 140 pounds and must be transported overland with a trailer. This makes it difficult for one or two people to move them from home to the water and back in one afternoon. In contrast, the boat of the present invention can be disassembled and gathered together in a single, small elongated bundle that is easily loadable atop a standard-size automobile by one or two persons. Starting fully assembled, the prototype described above can be completely broken down and secured on a car in thirty minutes. The heaviest component is the platform, which when made of aluminum is 60 pounds or less and, when made of plastic, about 20% lighter.

DETAILED DESCRIPTION OF THE INVENTION

Figure 1:
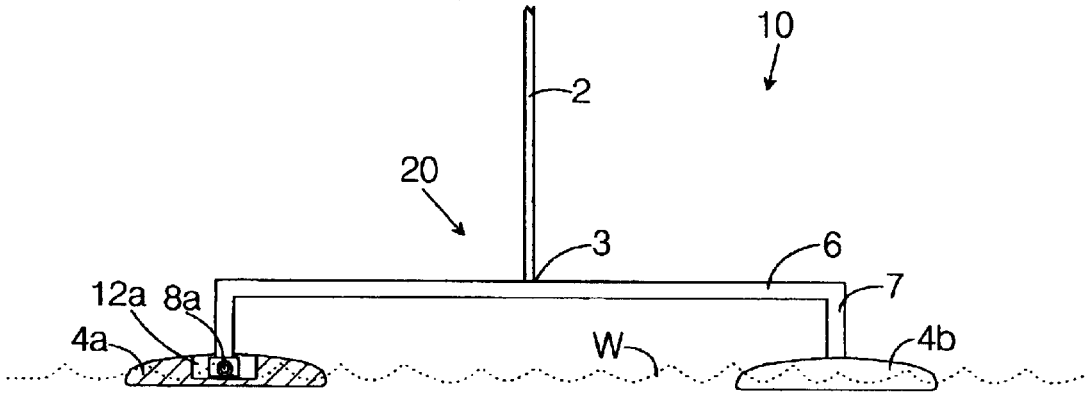
FIG. 1 is an elevation view of a catamaran according to the present, where the catamaran's orientation and configuration are that which prevail in the absence of wind.
Figure 2:
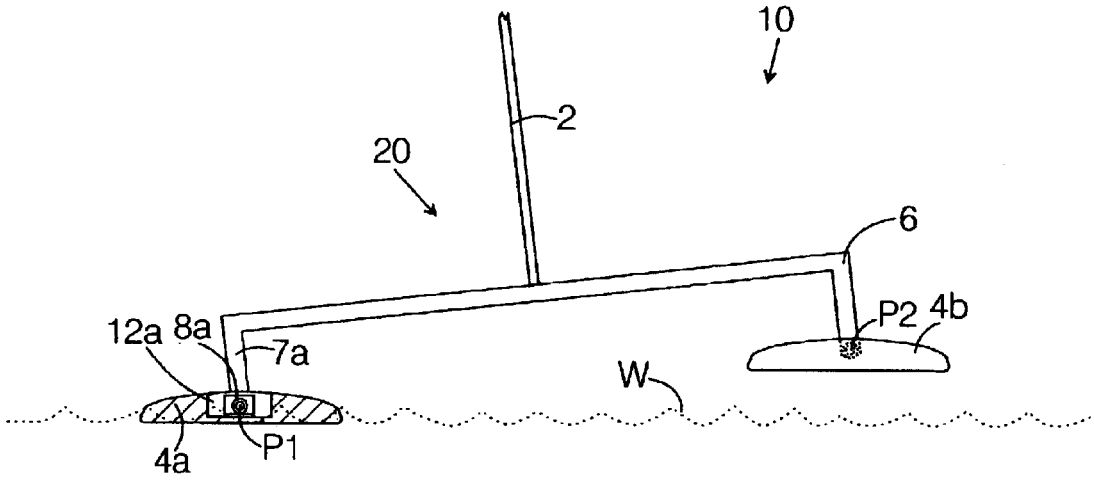
FIG. 2 is similar to FIG. 1, except that now the catamaran's orientation and configuration reflect a wind blowing from right to left and illustrate the pivotable coupling between hulls and superstructure.
Figure 3:
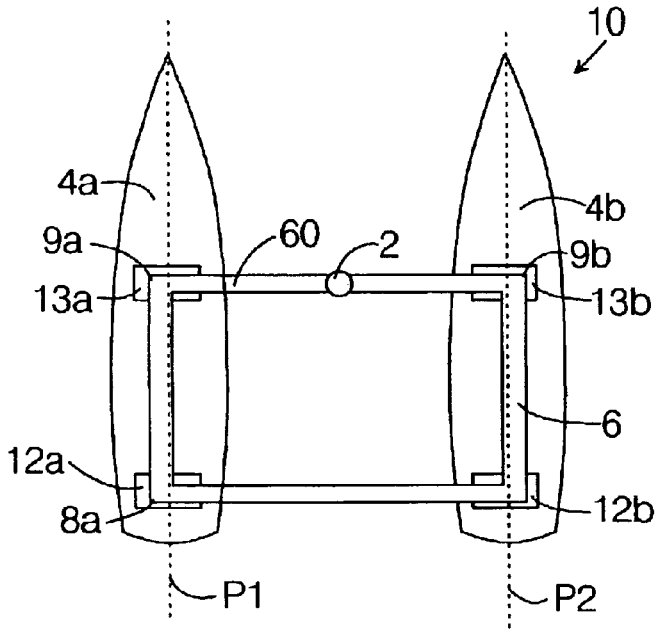
FIG. 3 is a top view of the vessel of FIG. 1, showing its two hulls and platform.

FIG. 1, FIG. 2, and FIG. 3 schematically show a catamaran vessel 10 according to the present invention, the vessel 10 including a first hull 4*a*, a second hull 4*b*, and a superstructure 20, where both the first hull 4*a* and the second hull 4*b* are flat on the bottom. The superstructure 20 includes a platform 6 and a mast 2, the mast 2 having a lower mast end 3 rigidly connected to the platform 6.

FIG. 1 shows the vessel 10 under a condition of zero wind; FIG. 2 shows the vessel 10 in a heeling configuration, under wind, illustrating the articulation between the superstructure 20 and the first hull 4*a* and the second hull 4*b*; and FIG. 3 is a topdown view of the vessel 10 that shows that the platform 6 has four sides, one of which is a mast-support beam 60. The mast-support beam 60 is the leading edge of the platform 6.

Because of the bilateral symmetry of the vessel 10, it is only necessary to describe one side of it. FIG. 3 shows the first hull 4*a* to have a first forward platform mount 13*a*, a first rearward platform mount 12*a*, a first forward pivot joint 9*a* and a first rearward pivot joint 8*a*. Because all of the pivot joints on the vessel 10 are similar, it suffices to describe one of them in detail.

Figure 4:
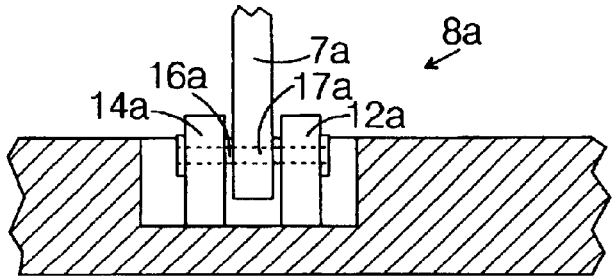
FIG. 4 is a partial cross-sectional view of a representative articulation joint by which the superstructure of the vessel is coupled to a hull, viewed along an axis perpendicular to the long dimension of the hull.
Figure 5:
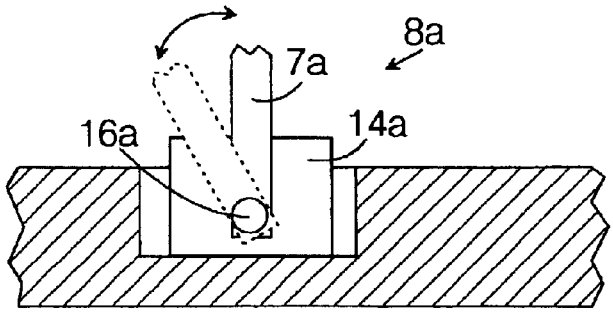
FIG. 5 is a partial cross-sectional view of the articulation joint of FIG. 4, viewed parallel to the long dimension of the hull, illustrating what occurs when the vessel heels while the hull remains horizontal.

As depicted in FIG. 4 and FIG. 5, the first rearward pivot joint 8*a* in the preferred embodiments is a simple pin joint that includes a first rearward throughbore 16*a* that passes through a pair of first rearward mounting plates 14*a* and a first rearward platform leg 7*a*. When the joint is assembled for operation, a first rearward pivot pin 17*a* is placed through the first rearward throughbore 16*a*, thus linking the first rearward platform leg 7*a* to the first hull 4*a*. The view of the first rearward pivot join 8*a* provided in FIG. 5 is at right angles to that provided in FIG. 4 and is located at the depth of the first rearward platform leg 7*a*. By means of the broken line and the arrow, FIG. 5 illustrates how the first rearward platform leg 7*a* changes in orientation with respect to the first hull 4*a* when the vessel 10 heels while underway in a wind.

Once this the couplings have also been completed at the other three pivot joints, the superstructure 20 is pivotably coupled to the first hull 4*a* and the second hull 4*b* and can independently pivot about either a first pivot axis P1 or a second pivot axis P2, as identified in FIG. 3. The first pivot axis P1 parallels the long dimension of the first hull 4*a* and passes through the first rearward pivot joint 8*a* and a first forward pivot joint 9*a*. Similarly, the second pivot axis P2 parallels the long dimension of the second hull 4*b* and passes through a second rearward pivot joint 8*b* and a second forward pivot joint 9*b*, as illustrated in FIG. 3. FIG. 2 illustrates how the superstructure 20 rotates as a rigid structure relative to the first hull 4*a* and the second hull 4*b*.

The depiction of the vessel 10 heeling in the wind as shown in FIG. 2, has the first hull 4*a* to the leeward. As the leeward hull, the first hull 4*a* remains horizontal and substantially in contact with a water surface W, while the second hull 4*b*, which is the windward hull, lifts above the water surface W, while remaining parallel to the water surface W. During this shift, neither the mast 2 nor the platform legs 7 have changed orientation relative to the plane of the platform 6. The superstructure 20 has, however, rotated axially about the first pivot axis P1 and is no longer parallel to the water surface W. At the same time, the windward hull has rotated about the second pivot axis P2, so that it can remain parallel to the water surface W.

Figure 6:
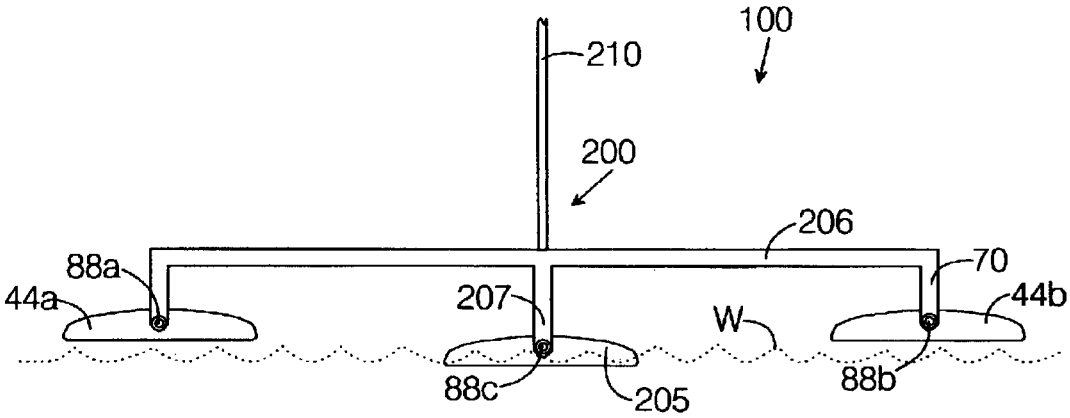
FIG. 6 is an elevation view of a trimaran vessel according to the present invention.
Figure 7:
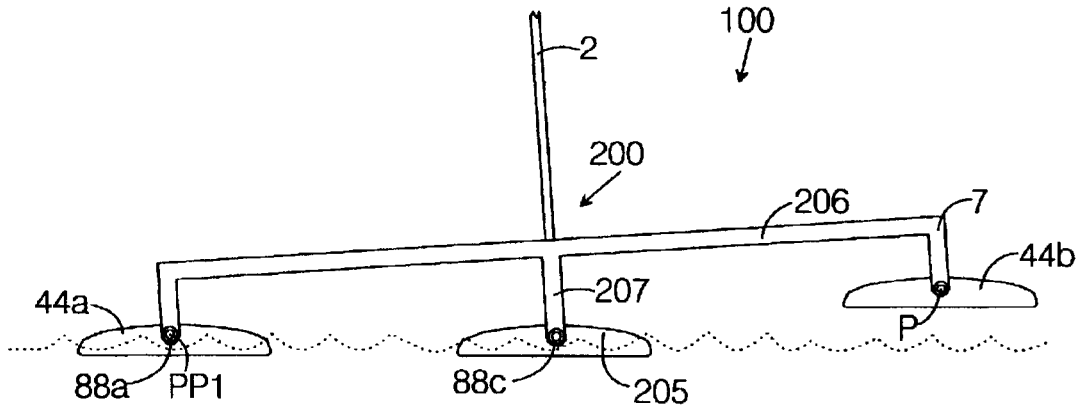
FIG. 7 is an elevation view of the trimaran vessel of FIG. 6 illustrating the articulation between hull and superstructure when the vessel is heeling to leeward.
Figure 8:
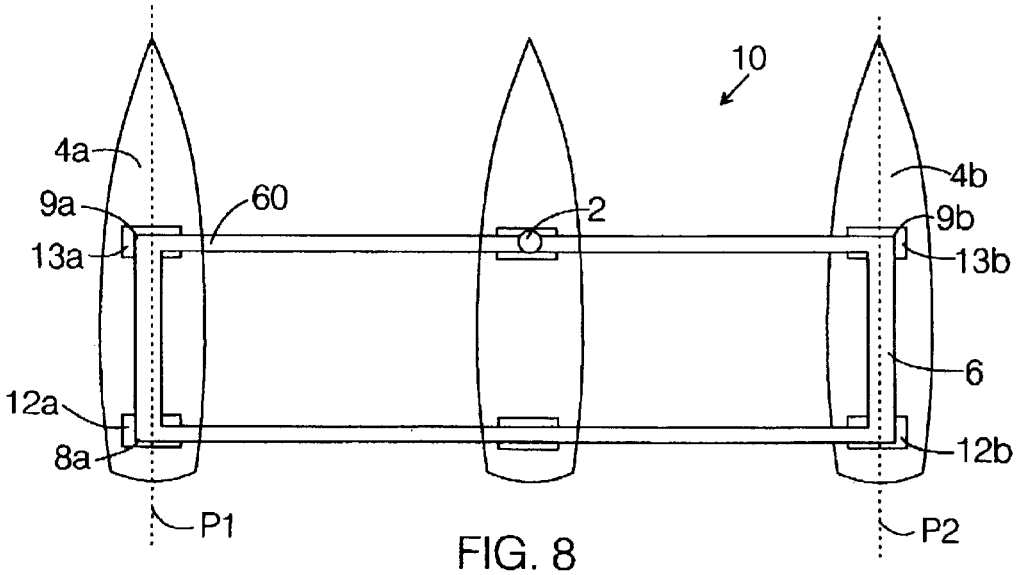
FIG. 8 is a top-down view of the trimaran depicted in FIG. 6 and FIG. 7.

FIG. 6, FIG. 7, and FIG. 8 illustrate a second embodiment of the invention, a trimaran vessel 100. The trimaran vessel 100 has a superstructure 200 that includes a mast 210 and a platform 206. The platform 206 has outer platform legs 70 and center platform legs 207. The platform 206 is rotatably linked to a first outer hull 44*a* and a second outer hull 44*b* in the same manner as shown in the FIG. 3 through FIG.5 for the first-described embodiment, namely through pivot joints including a first outer rearward pivot joint 88*a* and a first outer forward pivot joint 99*a*. In addition to the first outer hull 44*a* and the second outer hull 44*b*, the trimaran vessel 100 has a center hull 205, which is also flat. The center platform legs 207 extend from the platform 206 to the center hull 205 and are also rotatably linked to the center hull 205, by means of pivot joints similar in detail to the one shown in FIG. 3 through FIG. 5. Note that in FIG. 6, illustrating the trimaran vessel 100 in a calm, the first outer hull 44*a* and the second outer hull 44*b* are both position higher than the center hull 205 and are in fact not in contact with the water. This follows from the relative lengths of the outer platform legs 70 on the one hand and the center platform legs 207, on the other.

FIG. 7 illustrates what happens when the trimaran vessel 200 is heeling with the first outer hull 44*a* to the leeward. The first outer hull now comes into contact with the water W, and may actually become somewhat submerged while remaining parallel to the surface of the water W, while the center hull 205 remains on the surface to which it remains parallel. In contrast, the second outer hull 44*b* is now raised even higher above the water surface W, while remaining parallel to the water surface W. Similar to the case with the catamaran vessel 10 under heeling conditions, the superstructure 200 has pivoted about a first trimaran pivot axis PP1 that runs through a first rearward pivot joint 88*a* and a first forward pivot joint 99*a* of the first outer hull 44*a*, because it is the leeward hull, just as with the counterparts described above and shown in FIG. 2 and FIG. 3.

Conventional materials are used for constructing the vessel according to the preferred embodiments of the invention. All of the hulls are constructed of a foam core covered with a composite material, such as is used for the construction of sail boards.

The description of the embodiments of the vessel according to the invention are illustrative of the general principles of the invention and are not intended to be limiting. Rather, it is to be understood that persons skilled in the art will be able to make numerous variations of the invention without straying from the scope of the present invention. This is particularly true of the details by which the articulation between superstructure and hulls is achieved and in the particular choices of materials for the components of the sailboats built in accord with the invention.

Having set out a description of my invention, I claim:

1. An improvement in multi-hull watercraft that include a superstructure, a plurality of hulls, and a longitudinal axis, wherein said superstructure includes a mast and a platform, said mast being rigidly affixable to said platform, said improvement comprising (a) an articulated coupling between said superstructure and said plurality of hulls wherein said articulated coupling is configured so as to allow each of said plurality of hulls to pivot with respect to said superstructure in such manner that each of said plurality of hulls can maintain a substantially horizontal orientation, parallel to a water surface while said superstructure changes in superstructure orientation with respect to said water surface and (b) flat bottoms on all of said plurality of hulls with no protuberances.

2. The improvement of claim 1 also including an underwater fin on said platform.

3. The improvement of claim 2 wherein said articulated coupling comprises a plurality of pivot connections joining said platform to each of said plurality of hulls.

4. The improvement of claim 3 wherein said platform includes a substantially planar section and a plurality of platform legs, said platform legs being rigidly connected to a perimeter of said planar section and deployed perpendicular to said planar section, and wherein each of said pivot connections couples a bottom end of one of said platform legs to one of said plurality of hulls, and wherein each of said of said plurality of hulls contains more than one of said pivot connections.

5. The improvement of claim 4 wherein each of said pivot connections includes a mounting plate with a pair of mounting plate flanges wherein said pair is adapted to accept therebetween said bottom end of one of said platform legs and wherein a pivot pin is deployable so as to pass horizontally through said pair and through said bottom end at right angles to said longitudinal axis, thereby forming a pivot joint about which said one of said platform legs can rotate.

6. A catamaran including a catamaran longitudinal axis, a superstructure having a mast and a platform, wherein said mast is rigidly affixed to said platform, and a first hull and a second hull, said first hull and said second hull being flat-bottomed with no underwater protuberances, wherein said platform has a plurality of platform legs, said platform legs being rigidly affixed to said platform and pivotably affixable to first pivot mounts located on a first-hull center line on said first hull and to second pivot mounts located on a second-hull center line on said second hull.

7. The catamaran of claim 6 wherein a fin extends downward from said platform.

8. The catamaran of claim 7 wherein said first pivot mounts are aligned along a first-hull longitudinal axis of said first hull and said second pivot mounts are aligned along a second-hull longitudinal axis of said second hull, and wherein a first half of said plurality of platform legs is pivotably affixed to said first pivot mounts and a second half of said plurality of said platform legs is pivotably affixed to said second pivot mounts.

9. The catamaran of claim 8 wherein each of said pivot mounts includes a plate, said plate having a planar portion affixed to one of said hulls and wherein said plate bears a pair of vertical flanges and a flange region therewithin forming a flange channel parallel to said catamaran longitudinal axis, said flange channel being adapted to receive a bottom of one of said platform legs, wherein said vertical flanges have a throughbore oriented horizontally perpendicular to said catamaran longitudinal axis and adapted to align with a platform leg pivot hole.

10. The catamaran of claim 9 further equipped with a plurality of pivot pins equal in number to said plurality of platform legs and wherein each of said pivot pins is adapted to pass through one said pairs of vertical flanges thereby pivotably coupling one of said platform logs to said one of said pairs of vertical flanges.

11. A catamaran including a catamaran longitudinal axis, a superstructure having a mast and a platform, wherein said mast is rigidly affixed to said platform, and a first hull and a second hull, wherein said platform has a plurality of platform legs rigidly affixed to said platform and pivotably affixable to pivot mounts, wherein a first half of said pivot mounts is located on said first hull along a centerline thereof, and wherein a second half of said pivot mounts is located on said second hull along a centerline thereof, wherein said first hull has a first hull bottom that is substantially flat and wherein said second hull has a second hull bottom that is substantially flat, both said first hull bottom and said second hull bottom being designed to be deployed parallel to a water surface, wherein each of said pivot mounts includes a plate, said plate having a planar portion affixed to one of said hulls and wherein said plate bears a pair of vertical flanges and a flanges region therewithin forming a flange channel parallel to said catamaran longitudinal axis, said flange channel being adapted to received a bottom of one of said platform legs, wherein said vertical flanges have a throughbore oriented horizontally perpendicular to said catamaran longitudinal axis and adapted to align with a platform leg pivot hole, wherein said catamaran is equipped with a plurality of pivot pins equal in number to said plurality of platform legs and wherein each of said pivot pins is adapted to pass through one of said pairs of vertical flanges thereby pivotably coupling one of said platform legs to said one of said pairs of vertical flanges, wherein said platform is configured to be disassembled and bundleable with said first hull and said second hull so as to form a single longitudinal traveling bundle capable of being lifted atop a standard-sized automobile by one or two persons and transported atop said automobile for assembly elsewhere.

12. A multihulled boat comprising a first outer hull, a second outer hull, a center hull, said first outer hull, said second outer hull, and said center hull all being flat-bottomed with no protuberances extending therefrom, and a superstructure, wherein said superstructure includes a mast and a platform and wherein said superstructure is coupled to said first outer hull by a plurality of first outer legs, to said second outer hull by a plurality of second outer legs, and to said center hull by a plurality of center legs, said first outer legs, said second outer legs, and said center legs all being rigidly affixed to said platform, all in such manner that said first outer hull can rotate about a longitudinal axis thereof with respect to said first outer legs, wherein said second outer hull can rotate about a longitudinal axis thereof with respect to said second outer legs, and wherein said center hull can rotated about a longitudinal axis thereof with respect to said center legs.

13. The multihulled boat as described in claim 12 wherein said first outer legs, said second outer legs and said center legs are configured such that in calm weather said first outer hull and said second outer hull are suspended above said water parallel to said water.

14. The multihulled boat as described in claim 13 configured such that as said boat is sailing under wind said superstructure can heel over while said center hull, said first outer hull, and said second outer hull remain parallel to said water.

15. A trimaran comprising a first outer hull, a second outer hull, a center hull, said first outer hull, said second outer hull, and said center hull all being flat-bottomed with no protuberances extending therefrom, and a superstructure, wherein said superstructure includes a mast and a platform and wherein said superstructure is coupled to said first outer hull by a plurality of first outer legs, to said second outer hull by a plurality of second outer legs, and to said center hull by a plurality of center legs, said first outer legs, said second outer legs, and said center legs all being rigidly affixed to said platform, all in such manner that said first outer hull can rotate about a longitudinal axis thereof with respect to said first outer legs, wherein said second outer hull can rotate about a longitudinal axis thereof with respect to said second outer legs, and wherein said center hull can rotated about a longitudinal axis thereof with respect to said center legs.

16. The trimaran as described in claim 15 wherein said first outer legs, said second outer legs and said center legs are configured such that in calm weather said first outer hull and said second outer hull are suspended above said water parallel to said water.

17. The trimaran as described in claim 16 configured such that as said boat is sailing under wind said superstructure can heel over while said center hull, said first outer hull, and said second outer hull remain parallel to said water.

18. The trimaran of claim 17, wherein said platform is configured to be disassembled and bundleable with said first outer hull, said second outer hull, and said center hull so as to form a single longitudinal traveling bundle capable of being lifted atop a standard-sized automobile by one or two persons and transported atop said automobile for assembly elsewhere.

* * * * *